US009394766B2

(12) United States Patent
Holderman et al.

(10) Patent No.: US 9,394,766 B2
(45) Date of Patent: Jul. 19, 2016

(54) SUBTERRANEAN WELL TOOLS WITH DIRECTIONALLY CONTROLLING FLOW LAYER

(71) Applicant: HALLIBURTON ENERGY SERVICES, INC., Houston, TX (US)

(72) Inventors: Luke William Holderman, Plano, TX (US); Michael Fripp, Carrollton, TX (US); Jean Marc Lopez, Plano, TX (US); Liang Zhao, Carollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 13/978,126

(22) PCT Filed: Oct. 29, 2012

(86) PCT No.: PCT/US2012/062416
§ 371 (c)(1),
(2) Date: Jul. 2, 2013

(87) PCT Pub. No.: WO2014/070135
PCT Pub. Date: May 8, 2014

(65) Prior Publication Data

US 2015/0226041 A1 Aug. 13, 2015

(51) Int. Cl.

| | |
|---|---|
| ***E21B 43/08*** | (2006.01) |
| ***E21B 43/12*** | (2006.01) |
| ***E21B 34/06*** | (2006.01) |
| ***E21B 34/08*** | (2006.01) |

(52) U.S. Cl.
CPC ..... *E21B 43/086* (2013.01); *E21B 34/06* (2013.01); *E21B 34/063* (2013.01); *E21B 34/08* (2013.01); *E21B 43/08* (2013.01); *E21B 43/12* (2013.01)

(58) Field of Classification Search
CPC ..... E21B 43/086; E21B 34/08; E21B 34/063
See application file for complete search history.

(56) References Cited

U.S. PATENT DOCUMENTS

| | | | | |
|---|---|---|---|---|
| 5,305,468 | A | 4/1994 | Bruckert et al. | |
| 6,382,318 | B1 | 5/2002 | Whitlock | |
| 6,789,624 | B2 * | 9/2004 | McGregor et al. | 166/278 |
| 6,886,634 | B2 * | 5/2005 | Richards | 166/278 |
| 7,096,945 | B2 * | 8/2006 | Richards et al. | 166/276 |
| 7,204,316 | B2 * | 4/2007 | Dusterhoft et al. | 166/381 |
| 8,291,976 | B2 * | 10/2012 | Schultz et al. | 166/272.3 |
| 8,316,952 | B2 * | 11/2012 | Moen | 166/373 |
| 8,985,207 | B2 * | 3/2015 | Thorkildsen et al. | 166/278 |
| 2002/0155010 | A1 * | 10/2002 | Karp et al. | 417/413.2 |
| 2003/0221828 | A1 * | 12/2003 | McGregor et al. | 166/278 |
| 2004/0020832 | A1 | 2/2004 | Richards et al. | |
| 2004/0035591 | A1 * | 2/2004 | Echols | 166/386 |

(Continued)

FOREIGN PATENT DOCUMENTS

CA 2513240 A1 * 2/2006

OTHER PUBLICATIONS

International Search Report dated Apr. 25, 2013 for Application No. PCT/US2012/062416.
Written Opinion dated Apr. 25, 2013 for Application No. PCT/US2012/062416.

(Continued)

*Primary Examiner* — Jennifer H Gay
(74) *Attorney, Agent, or Firm* — Haynes and Boone, LLP

(57) ABSTRACT

A flow direction controlling layer for use in controlling the flow of fluids in subterranean well tools. The control layer comprises micro check valve arrays formed in the tool.

11 Claims, 5 Drawing Sheets

(56) References Cited

U.S. PATENT DOCUMENTS

| | | | | |
|---|---|---|---|---|
| 2004/0134655 | A1* | 7/2004 | Richards | 166/276 |
| 2004/0160726 | A1* | 8/2004 | Lerche et al. | 361/233 |
| 2005/0155772 | A1 | 7/2005 | Dusterhoft et al. | |
| 2005/0205265 | A1 | 9/2005 | Todd et al. | |
| 2006/0065397 | A1 | 3/2006 | Nguyen et al. | |
| 2010/0267591 | A1 | 10/2010 | Todd et al. | |
| 2011/0011585 | A1 | 1/2011 | OMalley | |
| 2011/0139453 | A1* | 6/2011 | Schultz et al. | 166/272.3 |
| 2011/0247813 | A1 | 10/2011 | Moen | |
| 2011/0303420 | A1* | 12/2011 | Thorkildsen et al. | 166/373 |
| 2012/0031623 | A1 | 2/2012 | Elrick et al. | |
| 2013/0068325 | A1* | 3/2013 | Herz et al. | 137/565.01 |
| 2015/0027726 | A1* | 1/2015 | Bruce et al. | 166/373 |

OTHER PUBLICATIONS

Albertson, A.C., "Degradable Aliphatic Polyesters", Advances in Polymer Science, vol. 157, pp. 1-41, Jan. 2001.

Steinbuchel, A., "Biopolymers," vol. 4: Polyesters III: Applications and Commercial products, pp. 1-52.

Steinbuchel, A., "Biopolymers," vol. 3b: Polyesters II: properties and Chemical Synthesis, pp. 203-231.

Examination Report issued by the Intellectual Property Office of Great Britain for corresponding Patent Application No. GB1505853.0, dated Oct. 21, 2015, 2 pages.

Invitation to Respond to Written Opinion issued by the Intellectual Property Office of Singapore regarding related Singapore Patent Application No. 11201503093X, dated Mar. 3, 2016, 12 pages.

* cited by examiner

SUBTERRANEAN WELL TOOLS WITH DIRECTIONALLY CONTROLLING FLOW LAYER

CROSS-REFERENCE TO RELATED APPLICATIONS

Not applicable.

STATEMENT REGARDING FEDERALLY SPONSORED

Not applicable.

RESEARCH OR DEVELOPMENT

Not applicable.

REFERENCE TO A MICROFICHE APPENDIX

Not applicable.

BACKGROUND

The present invention relates to controlling the flow of fluids and, more particularly, to the valve arrays used to control the flow of well fluids in a subterranean well tool. Still, more particularly, the present invention relates to the method and apparatus for using layers containing micro check valve arrays to control the flow of fluids in subterranean well filters.

Well filters are typically used in subterranean well environments in which it is desired to remove a liquid or gas from the ground, without bringing soil particulates, such as sand or clay, up with the liquid or gas. A well filter generally includes an inner support member, such as a perforated core and a filter body, including a filter medium disposed around the inner support member. In many cases, the well filter will further include an outer protective member, such as a perforated cage or shroud, disposed around the filter body for protecting it from abrasion and impacts. A filter for subterranean use is described in U.S. Pat. No. 6,382,318, which is hereby incorporated herein by reference for all purposes. A downhole screen and method of manufacture is described in U.S. Pat. No. 5,305,468, which is hereby incorporated herein by reference for all purposes. A downhole sand screen with a degradable layer is described in U.S. Pub. No. 2005/0155772, which is hereby incorporated herein by reference for all purposes.

It is desirable to be able to provide a flow path through the screen to provide circulation, while installing the screen in a well. In the past, such circulation has been provided by a washpipe extending through the screen. The washpipe permits fluid to be circulated through the screen before, during and after the screen is conveyed into the well, without allowing debris, mud, etc. to clog the screen. However, using a washpipe requires additional operations when completing the well for production of hydrocarbons.

Expandable and nonexpandable screens have been used in the past, either with or without the use of a washpipe. When a washpipe is not used, there is no sealed fluid path through the screen to allow fluids to be pumped from the top of the screen to the bottom. As a result, any attempt to circulate fluid in the well would result in large volumes of fluid being pumped through the screen media, potentially plugging or clogging the screen and potentially damaging the surrounding hydrocarbon bearing formation.

Degradable materials have been used and proposed in the past to completed block flow through the screen. These prior systems involve materials that dissolve or degrade over time when placed in the well. However, while the blocking materials degrade these systems prevent production from the well during degradation.

Accordingly, there is a need for improved methods and apparatus to permit circulation through an expandable well screen during its installation in a well, while not requiring additional well operations associated with use of a washpipe and which allow production to begin immediately, once treating fluid circulation ceases. Other benefits could also be provided by improved methods and systems for installing well screens in a well.

SUMMARY

Disclosed herein are subterranean well tools and a method for use in a well at a subterranean location. In an embodiment, sand screen is provided without the need of a washpipe. The screen is assembled with a circumferential layer, comprising an array of micro valves, which restricts or substantially blocks flow radially outward from the screens interior, yet open to permit flow through the screen from the exterior into the interior. The micro valves in the array act as check valves, preventing treating fluids pumped down the well to escape from the well through the screen and immediately allow flow from the formation to enter the well through the screen. In addition, the layer of micro valves can be constructed from materials that degrade or dissolve over time in the presence of well fluids. The method includes the steps of: providing the screen, including a permanent or degradable micro valve layer which prevents fluid flow out of the well through a wall of the screen; and positioning the screen in a wellbore, pumping well fluids through the screen, while preventing these fluids from escaping from the well through the screen and immediately thereafter permitting fluid flow into the well through the screen. It is envisioned that well tools, utilizing selective flow control through layered material, could be provided.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
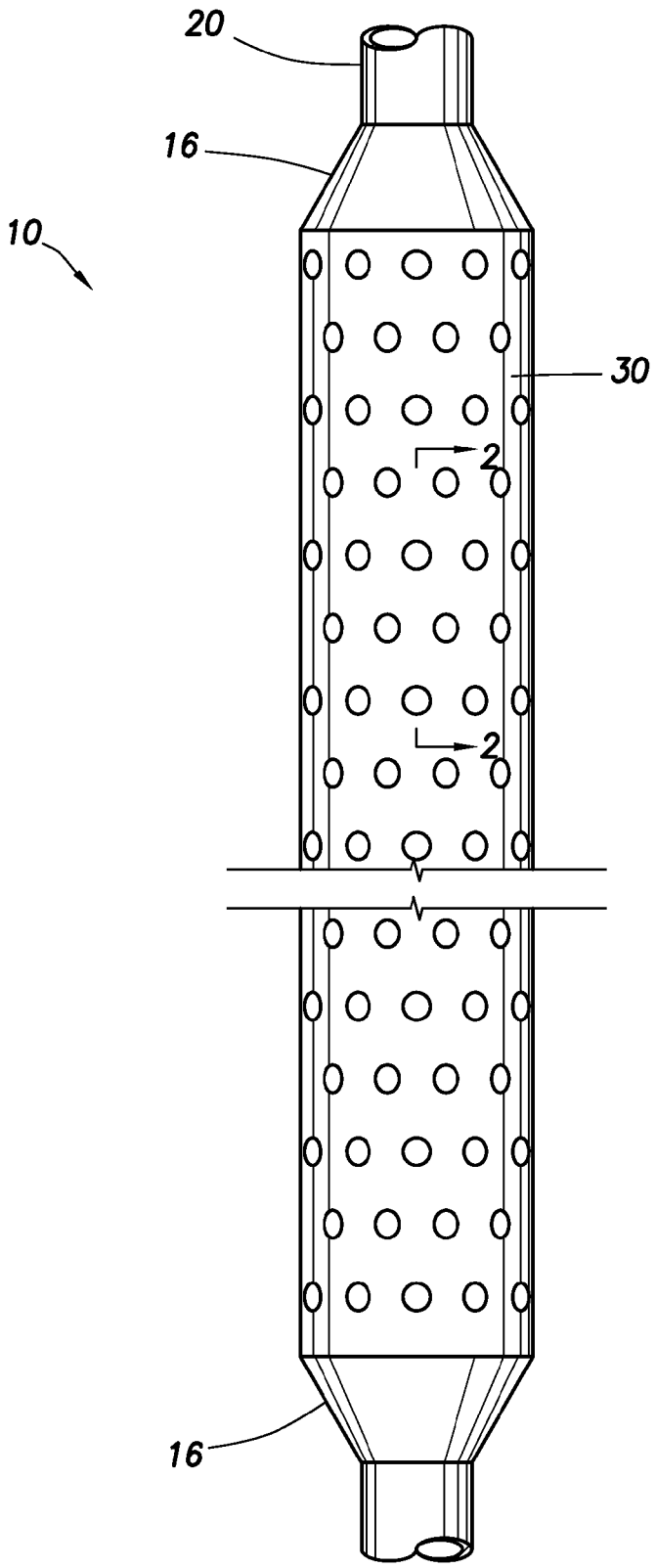
FIG. 1 is a side view of the sand screen, according to the present invention.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form, and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to." Reference to "up" or "down" will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation, such as horizontally and/or vertically spaced portions of the same formation.

The various characteristics mentioned above, as well as other features and characteristics described in more detail below, will be readily apparent to those skilled in the art with the aid of this disclosure upon reading the following detailed description of the embodiments and by referring to the accompanying drawings.

Figure 2:
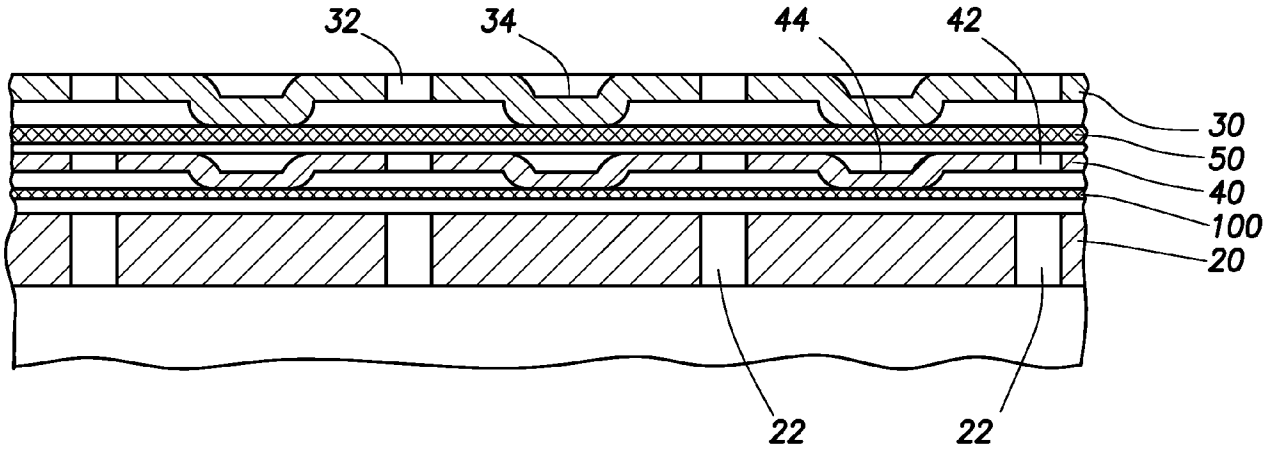
FIG. 2 is an enlarged, cross-sectional view of the sand screen taken on line 2-2 of FIG. 1, looking in the direction of the arrows.

Referring now to the drawings, wherein like reference characters are used throughout the several views to indicate like or corresponding parts, there is illustrated in FIGS. 1 and 2, a sand screen assembly 10 for use in a wellbore at a subterranean location. In the disclosed embodiment, the sand screen assembly comprises an elongated base pipe 20 of sufficient structural integrity to be connected to a tubing string and to support concentric outer tubular layers including: an outer shroud 30, the inner shroud 40, and a screen or filter layer 50. As used in regard to the screen layers the term "tubular" refers to a structure having a hollow center without regard to the outer shape. In FIG. 2, filter layer 50 is illustrated as a single mesh layer; however the filter layer could comprise multiple layers, for example, sand screen material sandwiched between two drainage layers. It is envisioned, however, that filter layer could include an outer relatively coarse wire mesh drainage layer, a relatively fine wire mesh filtering layer, and an inner relatively coarse wire mesh drainage layer all of which are positioned between the outer shrouds 30 and 40.

As will be described in more detail, the outer layers of the sand screen assembly 10 have their ends crimped onto the base pipe 20, as indicated by reference numeral 16. The base pipe 20 includes perforations 22, extending through the wall of the base pipe 20 along the length between the crimped and 16. As used herein, the term "perforation" is not intended to be cross section-shaped limiting and includes all shapes, for example, perforations which are circular, oblong, and slit shaped. As is well known in the industry, these openings in the base pipe need only be of a sufficient size and shape to facilitate flow without destroying the structural integrity of the base pipe.

As best illustrated in FIG. 2, the outer shroud 30 is tubular shaped and includes a plurality of perforations 32 to allow hydrocarbons to flow into the screen assembly 10. Preferably, the outer shroud 30 is also provided with a plurality of deformations 34 which extend radially from the inner wall of the outer shroud 30. The inner shroud 40 is of a similar tubular construction. Perforations 42 extend through the wall of the shroud and deformations 44 extend inwardly from the inner wall.

Preferably, at least one valve layer 100 is included in the screen assembly. In the FIG. 2 embodiment, micro valve layer 100 is positioned in the annular space between the inner shroud 40 and base pipe 20. Alternatively, valve layer 100 could be located anywhere in the filter 10, for example, between the inner and outer shrouds. Valve layer 100 comprises an array of flow directionally responsive valves restricting flow through the layer. In this embodiment, valve layer 100 is orientated to restrict fluid flow from the base pipe out through the filter layer and to allow flow from the filter layer into the base pipe. In another embodiment (not illustrated) the valve layer could be oppositely orientated in the tool to restrict fluid flow from the formation into the base pipe and to allow flow from the base pipe into the formation.

As best illustrated in FIG. 2, the inner shroud fits closely around the valve layer 100 around base pipe 20 with the inner extensions of the deformations 44, holding the inner shroud 40 away from the valve layer and outer wall of the base pipe to form drainage. The deformations 34 in the outer shroud 30 function in a similar manner to form drainage areas 36 between the inner wall of the outer shroud 30 and the filter layer 50.

Figure 3:
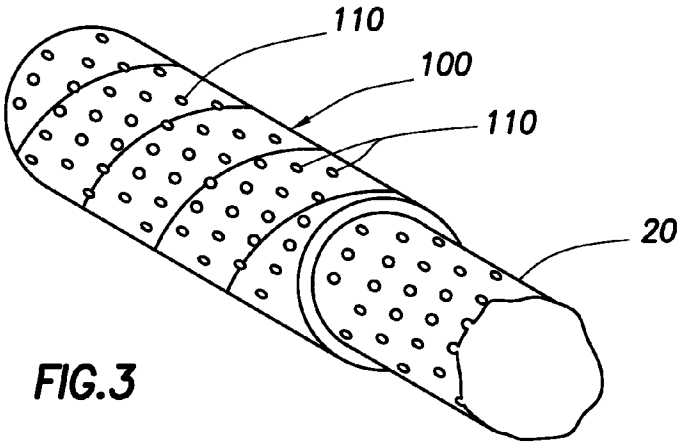
FIG. 3 is a perspective view, illustrating installation of the valve layer of the present invention wrapped on a base pipe.

As illustrated in FIG. 3, the valve layer 100 comprises a tubular structure formed from rectangular sheet material wrapped longitudinally around inner shroud 40. According to the method of assembling the screen assembly 10, the inner and outer shrouds are formed as tubular from material that is perforated and deformed as described. Next, screen mesh is used to form the filter layer 50. Next, the outer shroud is telescoped over the screen mesh 50 and inner shroud 40. The resulting assembly is telescoped over a perforated base pipe and valve layer, and the ends are closed off by crimping onto the base pipe.

Figure 4A:
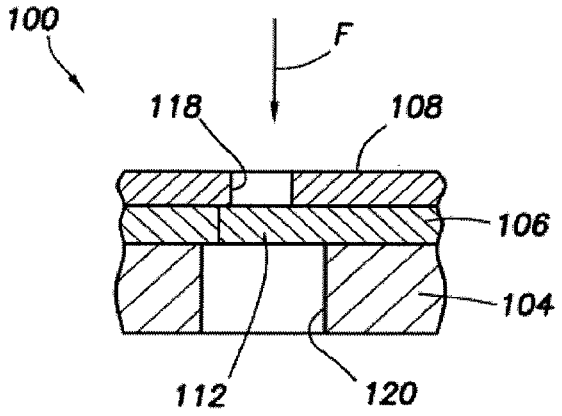
FIGS. 4A, 4B, 4C and 4D illustrate of one embodiment of the valve layer of the present invention.

FIGS. 4A and B illustrate a cross section of one embodiment of the valve layer 100. In this embodiment, an array 102 of cantilevered flap type micro valves 110 are formed from three layers of sheet material 104, 106 and 108 laminated together. In FIG. 4A, the valve is shown closed, restricting flow in the reverse direction of arrow F and, in FIG. 4B, it is illustrated open, allowing flow in the direction of arrow F. Preferably, 2 to 25 micron thick sheet material is used.

Figure 4B:
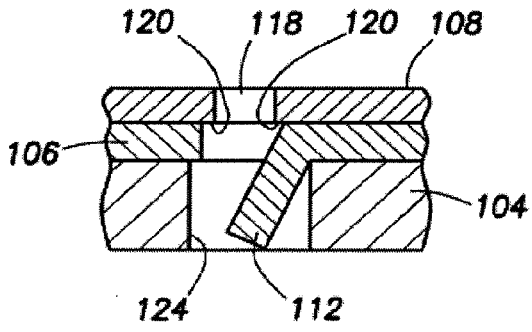

Material used to form the valves depends on the application, for example, in general scenarios where corrosive resistant is a requirement, 200 and 300 grade stainless materials like 202, 301, 304, 304L(H), 316 (L) may be used. However, other materials like non-ferrous materials and polymer materials may also be considered in case of low strength requirements or small scales. The sheet can be fabricated from a metal or metal alloy, such as steel, stainless steel, titanium alloys, aluminum alloys, nickel alloys. The sheet can be fabricated from a plastic, such as a thermoplastic, a thermoset plastic, PEEK, Teflon, and these plastics can be reinforced with fibers, such as a carbon fiber composite or with particles, such as a filled Teflon. The sheet can be formed from an elastomer, a hinged ceramic or glass, a fabric, a mesh, a composite or any other material or combination of materials suited to the task. In well tool embodiments (for example, the sand screen), the array 102 is installed with inner layer 104 on the side from which flow is restricted and outer layer 108 on the side from which flow is allowed. In FIG. 4B, arrow F represents the direction flow is allowed to pass through the array 102, while flow is blocked or restricted in the reverse direction.

Figure 4C:
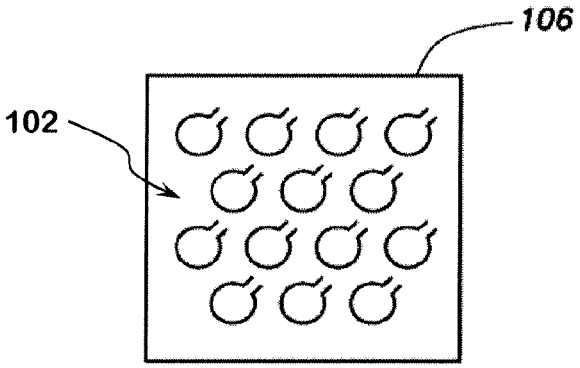
Figure 4D:
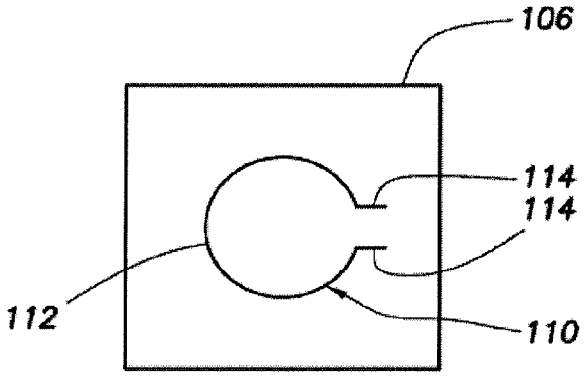

As illustrated in FIGS. 4C and 4D, a flexible sheet 106 of (for example, polymer material) is cut to form an array of tab-shaped valves elements. In this embodiment, the valve elements are generally circular shaped, however it is envisioned that other shapes could be used, such as polygons, quadrilaterals, triangles and other curved sided shapes. Each valve element is formed with a circular shaped cut 112 connected to two parallel spaced straight cuts 114. The space between cuts 114 for a tab which connects the valve element to the sheet 106 and acts as a hinge.

Outer sheet 108 has an array of openings 118 positioned to have the same spacing as to tab-shaped valve elements, so that, when sheets 104 and 106 are joined together the openings 118 and valves elements are aligned. Openings 118 are selected to be slightly smaller than the valves elements to form an annular seat 120 for the valve element to seal against. Inner sheet 104 contains openings 124. Openings 124 are larger than valves 110 and are spaced to align with the valves elements. Openings 124 provide clearance for the valve element to pivot to the open position, as illustrated in FIG. 4B. Inner sheet 104 is optional and would be unnecessary where clearance for the valve element is not required.

Figure 5A:
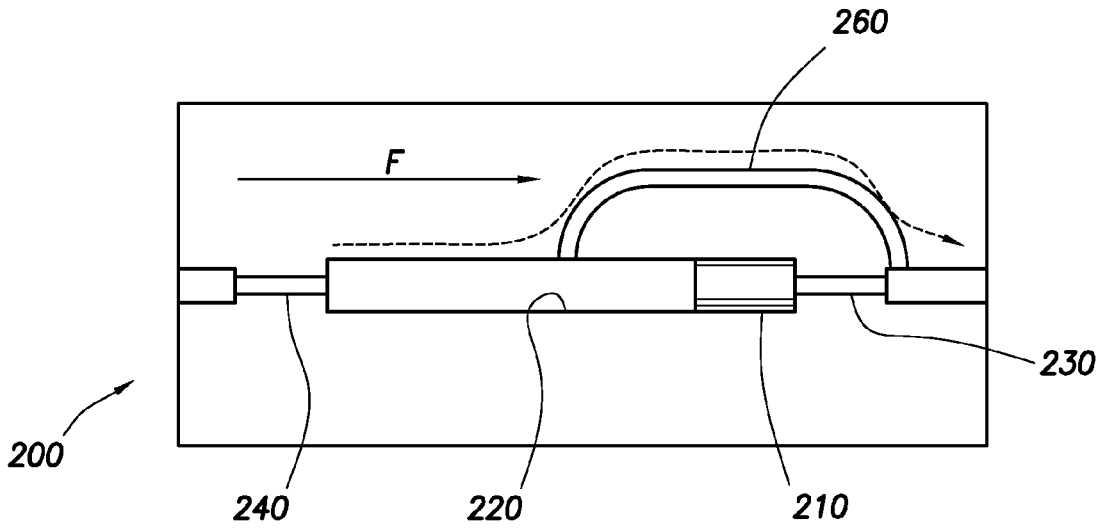
FIGS. 5A and B are diagrams of a second embodiment of the micro valve of the present invention.
Figure 5B:
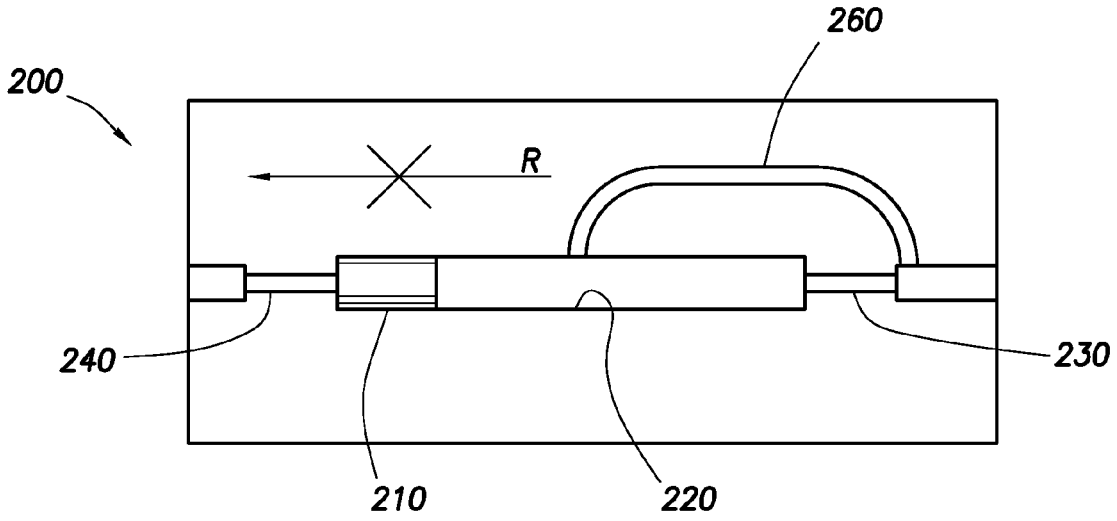
Figure 6:
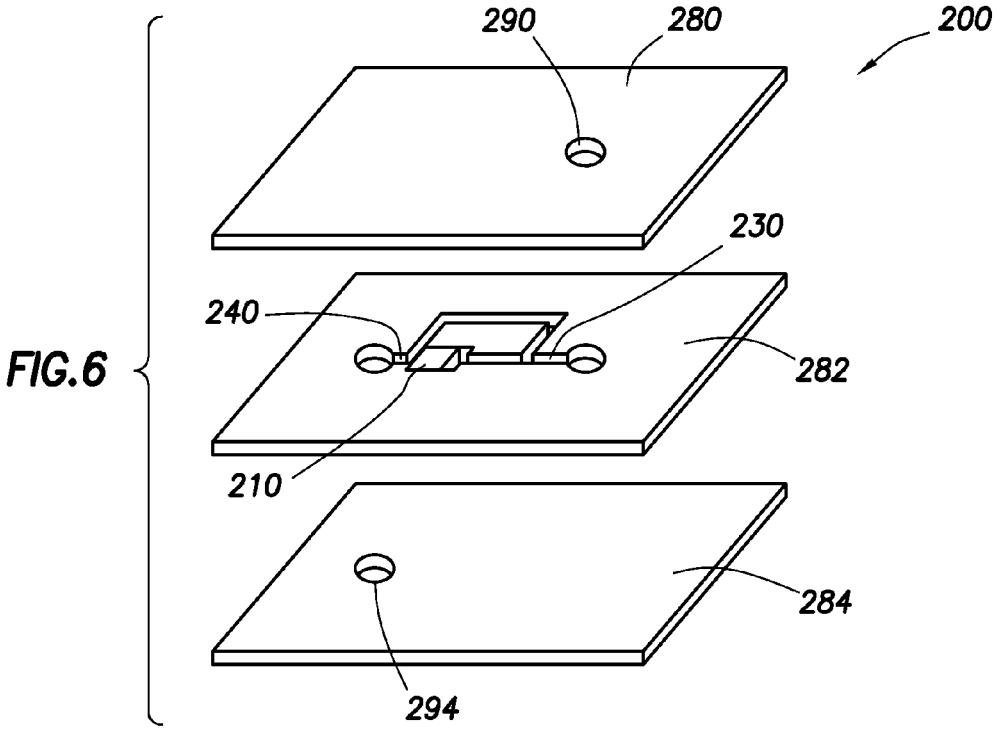
FIG. 6 is an exploded view of the second embodiment of the valve layer of the present invention.

FIGS. 5 and 6 illustrate another embodiment for a micro valves 200 included in the valve layer 100. FIG. 5 constitutes a schematic view of the valve configuration 200. Valve 200 has a piston-type movable valve element 210 that slides from left to right as viewed in FIGS. 5A and 5B in a slot 220. When valve element 210 is at the right end of the slot 220, as illustrated in FIG. 5A, fluid can flow through the valve in the direction of arrow F. When the valve element 210 is at the left-hand end of slot 220, as illustrated in FIG. 5B, fluid flow through the valve, in the direction of arrow R, is blocked if not substantially restricted. It is envisioned in applications where fluid injection into the formation is desired while flow back is not, the valves could be reversed to allow flow in the direction of arrow F and restrict flow in the opposite direction.

Slot 220 is connected at its right-hand end to a thinner slot 230 and at its left-hand end to a thin slot 240. A bypass slot 260 connects slot 230 to the intermediate portion of slot 220.

In operation as fluid moves into slot 240, it will cause a valve element 210 to move to the position illustrated in FIG. 5A. With the valve element 210 in the position illustrated in FIG. 5A, fluid will flow into the slot 220 of valve 200 via slot 240 and will exit the valve 200 and slot 220 via the bypass slot 260 and the slot 230. Although FIGS. 5 A and B show the microvalve as a free-moving piston, the piston could be tethered to the wall with a series of flexures or tethered to the end with a bellows mechanism.

If conditions surrounding the valve are such that fluid attempts to flow into the valve 200 through slot 230 in the direction of arrow R, the valve element 210 will move to the left-hand side as illustrated in FIG. 5B. In this position, flow through the valve 200 will be blocked. When used in the downhole sand filter embodiment, valve 200 would be positioned with slot 230 on the interior side of layer 100.

In FIG. 6, a configuration for assembling valve 200 from three separate sheets of material 280, 282, and 284 is illustrated. Only one valve configuration is illustrated in FIG. 6 but it is to be understood, of course, that valve layer 100 would comprise an array of valves 200. The sheets can be die cut to form the various components of the valve and glued, pressed, laid or fused together. Inner sheet 280 has a port 290 which, when the sheets are assembled together, aligns with and provides fluid communication with slot 230. Outer sheet 284 contains a port 294 which, when the sheets are assembled together, aligns with and provides fluid communication with slot 240. The middle sheet 282 is cut to form the configuration of the valve illustrated in FIGS. 5A and B. According to one feature of the invention, the valve element to 210 can be formed by cutting it out of interlayer 282.

Figure 7:
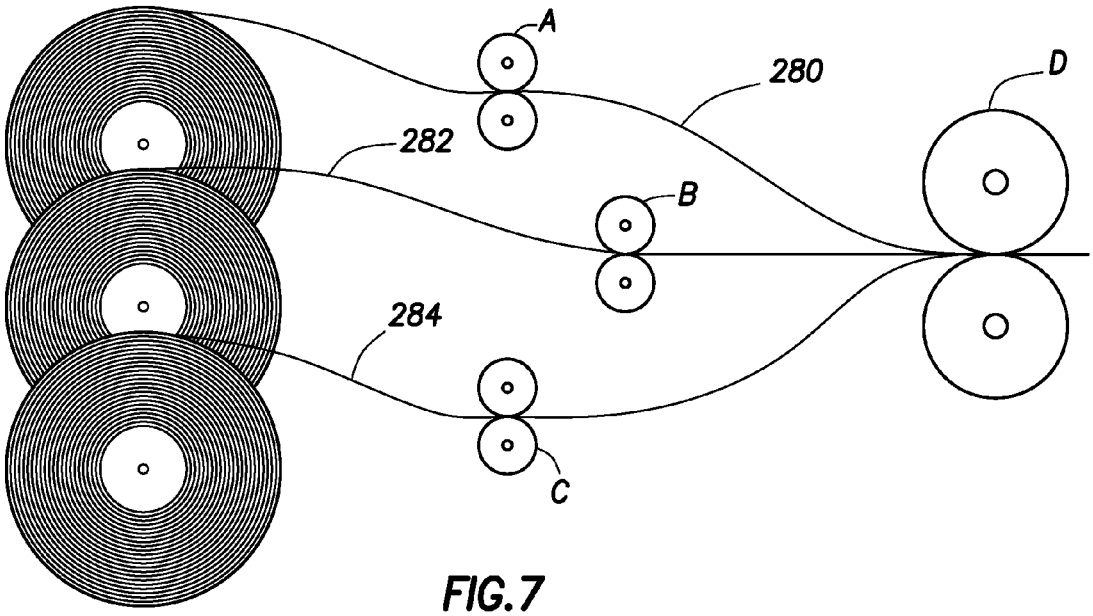
FIG. 7 is a diagram illustrating one method of forming the valve layer of the present invention.

FIG. 7 illustrates one method of forming the valve array of the various embodiments from sheet material. In this embodiment, the valve array is formed from three separate sheets of material; however, this configuration should be used for arrays formed from two or more sheets of material. For description purposes, the method will be described with respect to the embodiment of FIGS. 5 and 6. Each of the sheets, 280, 282 and 284 passes through a pair of cylindrical cutting dies, A, B, C, respectively. As the sheets pass between these cutting dies, patterns are cut in the sheets which will comprise an array of micro valves. The sheets, depending on their materials, then pass through a pair of cylindrical laminating dies D, which either glue or bond the layers together.

In the case of high pressure drop across the valve, and in the corrosive resistant environments, the 202, 301, 304, 304L(H), or 316(L) stainless materials may be used. The diameters of the valve could range from mm meter to cm meter scale. Accordingly, the thickness should be generally of a lower scale after a calculation based on the material strength and the bending angle requirements. Nonmetal material will have smaller diameter and relatively be thinner with the application of the low pressure drop across the valve. Each layer can range from 0.002 inches to 0.25 inches. Spacing can range from one per tubing joint to one per square centimeter. The valve diameter can range from ½ the layer thickness to over 50 times the layer thickness.

According to another feature of the present invention, the valve layer 100 can be made of material that degrades or dissolves over time or in the presence of certain materials. This has the advantage of allowing screen installation and well completion processes to be performed with the valve layer 100 in place and has the further advantage of further enhancing production by removing the valve layer.

As used herein, a degradable material is capable of undergoing an irreversible degradation downhole. The term "irreversible" as used herein means that the degradable material once degraded should not recrystallize or reconsolidate while downhole in the treatment zone, that is, the degradable material should degrade in situ but should not recrystallize or reconsolidate in situ.

The terms "degradable" or "degradation" refer to both the two relatively extreme cases of degradation that the degradable material may undergo, that is, heterogeneous (or bulk erosion) and homogeneous (or surface erosion), and any stage of degradation in between these two. Preferably, the degradable material degrades slowly over time, as opposed to instantaneously.

The degradable material is preferably "self-degrading." As referred to herein, the term "self-degrading" means bridging may be removed without the need to circulate a separate "clean up" solution or "breaker" into the treatment zone, wherein such clean up solution or breaker have no purpose other than to degrade the bridging in the proppant pack. Though "self-degrading," an operator may nevertheless elect to circulate a separate clean up solution through the well bore and into the treatment zone under certain circumstances, such as when the operator desires to hasten the rate of degradation. In certain embodiments, a degradable material is sufficiently acid-degradable is to be removed by such treatment. In another embodiment, the degradable material is sufficiently heat-degradable to be removed by the wellbore environment.

The degradation can be a result of, inter alia, a chemical or thermal reaction or a reaction induced by radiation. The degradable material is preferably selected to degrade by at least one mechanism selected from the group consisting of: hydrolysis, hydration followed by dissolution, dissolution, decomposition or sublimation.

The choice of degradable material can depend, at least in part, on the conditions of the well, e.g., wellbore temperature. For instance, lactides can be suitable for lower temperature wells, including those within the range of about 60° F. to about 150° F., and polylactides can be suitable for well bore temperatures above this range. Dehydrated salts may also be suitable for higher temperature wells.

In choosing the appropriate degradable material, the degradation products that will result should also be considered. It is to be understood that a degradable material can include mixtures of two or more different degradable compounds.

As for degradable polymers, a polymer is considered to be "degradable" herein if the degradation is due to, inter alia, chemical or radical process such as hydrolysis, oxidation, enzymatic degradation or UV radiation. The degradability of a polymer depends, at least in part, on its backbone structure. For instance, the presence of hydrolyzable or oxidizable linkages in the backbone often yields a material that will degrade as described herein. The rates at which such polymers degrade are dependent on the type of repetitive unit, composition, sequence, length, molecular geometry, molecular weight, morphology (e.g., crystallinity, size of spherulites, and orientation), hydrophilicity, hydrophobicity, surface area, and additives. Also, the environment to which the polymer is subjected may affect how the polymer degrades, e.g., temperature, presence of moisture, oxygen, microorganisms, enzymes, pH, and the like.

Some examples of degradable polymers are disclosed in U.S. Patent Publication No. 2010/0267591, having named inventors Bradley L. Todd and Trinidad Munoz, which is incorporated herein by reference. Additional examples of degradable polymers include, but are not limited to, those described in the publication, *Advances in Polymer Science*, Vol. 157, entitled "Degradable Aliphatic Polyesters." edited by A. C. Albertsson and the publication, "Biopolymers," Vols. 1-10, especially Vol. 3b, *Polyester II: Properties and Chemical Synthesis* and Vol. 4, *Polyester III: Application and Commercial Products*, edited by Alexander Steinbuchel, Wiley-VCM.

Some suitable polymers include poly(hydroxy alkanoate) (PHA); poly(alpha-hydroxy) acids, such as polylactic acid (PLA), polygylcolic acid (PGA), polylactide, and polyglycolide; poly(beta-hydroxy alkanoates), such as poly(beta-hydroxy butyrate) (PHB) and poly(beta-hydroxybutyrates-co-beta-hydroxyvelerate) (PHBV); poly(omega-hydroxy alkanoates) such as poly(beta-propiolactone) (PPL) and poly (ϵ-caprolactone) (PCL); poly(alkylene dicarboxylates), such as poly(ethylene succinate) (PES), poly(butylene succinate) (PBS); and poly(butylene succinate-co-butylene adipate); polyanhydrides, such as poly(adipic anhydride); poly(orthoesters); polycarbonates, such as poly(trimethylene carbonate); and poly(dioxepan-2-one)]; aliphatic polyesters; poly(lactides); poly(glycolides); poly(ϵ-caprolactones); poly(hydroxybutyrates); poly(anhydrides); aliphatic polycarbonates; poly(orthoesters); poly(amino acids); poly(ethylene oxides); and polyphosphazenes. Of these suitable polymers, aliphatic polyesters and polyanhydrides are preferred. Derivatives of the above materials may also be suitable, in particular, derivatives that have added functional groups that may help control degradation rates.

Of the suitable aliphatic polyesters, poly(lactide) is preferred. Poly(lactide) is synthesized, either from lactic acid by a condensation reaction or, more commonly, by ring-opening polymerization of cyclic lactide monomer. Since both lactic acid and lactide can achieve the same repeating unit, the general term "poly(lactic acid)" as used herein refers to Formula I, without any limitation as to how the polymer was made, such as from lactides, lactic acid or oligomers, and without reference to the degree of polymerization or level of plasticization.

The lactide monomer exists generally in three different forms: two stereoisomers (L- and D-lactide) and racemic DL-lactide (meso-lactide).

The chirality of the lactide units provides a means to adjust, inter alia, degradation rates, as well as physical and mechanical properties. Poly(L-lactide), for instance, is a semicrystalline polymer with a relatively slow hydrolysis rate. This could be desirable in applications where a slower degradation of the degradable material is desired. Poly(D,L-lactide) may be a more amorphous polymer with a resultant faster hydrolysis rate. This may be suitable for other applications where a more rapid degradation may be appropriate. The stereoisomers of lactic acid may be used individually or combined. Additionally, they may be copolymerized with, for example, glycolide or other monomers like ϵ-caprolactone, 1,5-dioxepan-2-one, trimethylene carbonate, or other suitable monomers to obtain polymers with different properties or degradation times. Additionally, the lactic acid stereoisomers can be modified to be used by, among other things, blending, copolymerizing or otherwise mixing the stereoisomers, blending, copolymerizing or otherwise mixing high and low molecular weight polylactides, or by blending, copolymerizing or otherwise mixing a polylactide with another polyester or polyesters. See U.S. Application Publication Nos. 2005/0205265 and 2006/0065397, incorporated herein by reference. One skilled in the art would recognize the utility of oligmers of other organic acids that are polyesters.

Certain anionic compounds that can bind a multivalent metal are degradable. More preferably, the anionic compound is capable of binding with any one of the following: calcium, magnesium, iron, lead, barium, strontium, titanium, zinc or zirconium. One skilled in the art would recognize that proper conditions (such as pH) may be required for this to take place.

A dehydrated compound may be used as a degradable material. As used herein, a dehydrated compound means a compound that is anhydrous or of a lower hydration state, but chemically reacts with water to form one or more hydrated states, where the hydrated state is more soluble than the dehydrated or lower hydrated state.

After the step of introducing a well tool, comprising a degradable material, the methods can include a step of allowing or causing the degradable material to degrade. This preferably occurs with time under the conditions in the zone of the subterranean fluid. It is contemplated, however, that a clean-up treatment could be introduced into the well to help degrade the degradable material.

According to the method of the present invention a well tool can be assembled comprising a fluid directional controlling valve layer. The tool such as a sand screen can be assembled in the string and placed in the well in a subterranean location. Subsequently well completion and treatment fluids can be produced into the well through the tubing all the valve layer controls flow of fluids from the tubing through the tool. After the well is treated, production can commence. In some embodiments, an additional step of degrading the materials, forming the valve layer can occur.

While compositions and methods are described in terms of "comprising," "containing," or "including" various components or steps, the compositions and methods also can "consist essentially of" or "consist of" the various components and steps. As used herein, the words "comprise," "have,"

"include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the Claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of installing a well screen in a subterranean well, the method comprising the steps of:

providing the well screen, the well screen comprising an elongated base pipe and a filter layer extending around the base pipe, the base pipe defining a plurality of perforations formed radially therethrough;

installing a valve layer in the well screen, comprising the steps of:

providing a first sheet of material, the first sheet defining a slot, the slot defining first and second end portions;

positioning a valve element within the slot, the valve element being movable between the first and second end portions;

providing a second sheet of material adjacent the first sheet, the second sheet defining a first opening in fluid communication with the first end portion;

providing a third sheet of material adjacent the first sheet so that the first sheet is disposed between the second and third sheets, the third sheet defining a second opening in fluid communication with the second end portion; and installing the first, second, and third sheets around the base pipe; and positioning the well screen, including the valve layer, in the well at a subterranean location.

2. The method of claim 1, further comprising the steps of:

sealing the valve element against the first, second, and third sheets at the first end portion of the slot to prevent the communication of a fluid from the second opening to the first opening; and sealing the valve element against the first, second, and third sheets at the second end portion of the slot to permit communication of the fluid from the first opening to the second opening.

3. A well screen for installation at a subterranean location in a well to filter solids from well fluids, the well screen comprising:

an elongated base pipe defining a plurality of perforations formed radially therethrough;

a filter layer extending around the base pipe; and a valve layer extending around the base pipe, the valve layer comprising:

a first sheet of material defining a slot, the slot defining first and second end portions;

a second sheet of material adjacent the first sheet and defining a first opening in fluid communication with the first end portion;

a third sheet of material adjacent the first sheet so that the first sheet is disposed between the second and third sheets, the third sheet defining a second opening in fluid communication with the second end portion; and a valve element positioned within the slot of the first sheet and movable between the first and second end portions.

4. The well screen according to claim 3, wherein, when the valve element is sealed against the first, second, and third sheets at the first end portion of the slot, the valve element prevents the communication of a fluid from the second opening to the first opening.

5. The well screen according to claim 3, wherein, when the valve element is sealed against the first, second, and third sheets at the second end portion of the slot, the valve element permits communication of a fluid from the first opening to the second opening.

6. The well screen according to claim 3, wherein the valve layer is positioned between the filter layer and the base pipe.

7. The well screen according to claim 3, wherein the first sheet of the valve layer comprises a plurality of the slots; and wherein the valve layer comprises a plurality of the valve elements positioned within the respective slots of the first sheet.

8. The well screen according to claim 7, wherein the second sheet of the valve layer comprises a plurality of the first openings in fluid communication with the respective first end portions of the slots; and wherein the third sheet of the valve layer comprises a plurality of the second openings in fluid communication with the respective second end portions of the slots.

9. The well screen according to claim 7, wherein the first sheet of the valve layer comprises flexible material.

10. The well screen according to claim 3, wherein the first, second, and third sheets are glued together to form the valve layer.

11. The well screen according to claim 3, wherein the valve layer comprises a degradable polymer.

* * * * *